US008811859B2

(12) United States Patent
Tsuritani et al.

(10) Patent No.: US 8,811,859 B2
(45) Date of Patent: Aug. 19, 2014

(54) DEVELOPER CONTAINER, DEVELOPMENT DEVICE, PROCESS UNIT, AND IMAGE FORMING APPARATUS

(75) Inventors: Shoh Tsuritani, Osaka (JP); Masanari Fujita, Osaka (JP); Yoshiyuki Shimizu, Osaka (JP); Tomohiro Kubota, Osaka (JP); Naoki Nakatake, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 113 days.

(21) Appl. No.: 13/554,270

(22) Filed: Jul. 20, 2012

(65) Prior Publication Data

US 2013/0028638 A1 Jan. 31, 2013

(30) Foreign Application Priority Data

Jul. 27, 2011 (JP) ..... 2011-164033

(51) Int. Cl.
*G03G 15/08* (2006.01)

(52) U.S. Cl.
USPC ..... 399/258; 399/254; 399/255; 399/256; 399/260; 399/262; 399/263

(58) Field of Classification Search
CPC ..... G03G 15/0822; G03G 15/0832; G03G 15/0839; G03G 15/0865; G03G 15/0877; G03G 15/0879; G03G 2215/066; G03G 2215/0802; G03G 2215/083; G03G 2215/0833; G03G 2215/085
USPC ..... 399/254–256, 258, 260, 262, 263
See application file for complete search history.

(56) References Cited

U.S. PATENT DOCUMENTS

| | | | | |
|---|---|---|---|---|
| 5,963,766 | A * | 10/1999 | Okuno et al. | 399/256 |
| 6,208,823 | B1 * | 3/2001 | Knott | 399/260 |
| 8,019,254 | B2 | 9/2011 | Tatsumi et al. | |
| 8,135,329 | B2 | 3/2012 | Shimizu et al. | |
| 2008/0145108 | A1 | 6/2008 | Yoshida et al. | |
| 2009/0214266 | A1 | 8/2009 | Kato et al. | |
| 2009/0220285 | A1 * | 9/2009 | Kimura et al. | 399/263 |
| 2011/0064473 | A1 | 3/2011 | Fujita et al. | |
| 2011/0255907 | A1 * | 10/2011 | Mihara et al. | 399/263 |
| 2012/0114373 | A1 | 5/2012 | Hamada et al. | |

(Continued)

FOREIGN PATENT DOCUMENTS

| | | | |
|---|---|---|---|
| CN | 1340745 | A | 3/2002 |
| CN | 1497398 | A | 5/2004 |
| CN | 101046660 | A | 10/2007 |

(Continued)

OTHER PUBLICATIONS

Combined Chinese Office Action and Search Report issued Dec. 23, 2013 in Patent Application No. 201210259669.3 (with English translation of categories of cited documents).

*Primary Examiner* — Ryan Walsh
(74) *Attorney, Agent, or Firm* — Oblon, Spivak, McClelland, Maier & Neustadt, L.L.P.

(57) ABSTRACT

A developer container includes a container body in which a developer containing chamber and a discharge outlet are formed, a developer conveyance member disposed inside the developer containing chamber and including a first conveyance portion and a second conveyance portion downstream from the first conveyance portion in a developer conveyance director, a canopy disposed inside the container body and facing the discharge outlet, a developer conveyance chamber defined by the canopy and an inner face of the container body in which the discharge outlet is formed, and a return opening formed in the canopy downstream from the discharge outlet. A developer conveyance velocity (Q2) of the second conveyance portion of the developer conveyance member to transports the developer toward the return opening is slower than a developer conveyance velocity (Q1) of the first conveyance portion of the developer conveyance member.

9 Claims, 12 Drawing Sheets

(56) References Cited

U.S. PATENT DOCUMENTS

| | | | | |
|---|---|---|---|---|
| 2012/0189327 | A1 | 7/2012 | Kubota et al. | |
| 2013/0149011 | A1* | 6/2013 | Hayashida et al. | 399/263 |
| 2014/0050502 | A1* | 2/2014 | Tsuritani et al. | 399/119 |

FOREIGN PATENT DOCUMENTS

| | | | |
|---|---|---|---|
| CN | 101458481 | A | 6/2009 |
| CN | 101533247 | A | 9/2009 |
| CN | 102109787 | A | 6/2011 |
| JP | 2005-77572 | | 3/2005 |
| JP | 2005-91914 | | 4/2005 |
| JP | 2008-170899 | | 7/2008 |
| JP | 2008-299260 | | 12/2008 |
| JP | 2009-139523 | | 6/2009 |
| JP | 2009-151228 | | 7/2009 |
| JP | 2010-14890 | | 1/2010 |

* cited by examiner

DEVELOPER CONTAINER, DEVELOPMENT DEVICE, PROCESS UNIT, AND IMAGE FORMING APPARATUS

CROSS-REFERENCE TO RELATED APPLICATION

This patent application is based on and claims priority pursuant to 35 U.S.C. §119 to Japanese Patent Application No. 2011-164033, filed on Jul. 27, 2011, in the Japan Patent Office, the entire disclosure of which is hereby incorporated by reference herein.

FIELD OF THE INVENTION

The present invention generally relates to a developer container for containing developer, and a development device, a process unit, and an image forming apparatus that include a developer container.

BACKGROUND OF THE INVENTION

In electrophotographic image forming apparatuses, such as, printers, facsimile machines, plotters, or multifunction machines including at least two of these functions, a photoreceptor, a development device, and the like are typically housed in a common unit casing, thus forming a modular unit (i.e., a process unit). Such process units are replaced when their operational lives expire. To reduce frequency of replacement of process units and running costs, operational lives of components have been extended.

Although the amount of developer necessary until the process unit is replaced increases in accordance with increases in the operational life thereof, increasing the size of a developer container provided inside the process unit is not desirable because the process unit as well as the image forming apparatus becomes bulkier. To keep the image forming apparatus compact and reduce the running cost, the developer container may be designed to be replaced independently.

To supply developer contained in the developer container to the development device, a discharge outlet is formed in the developer container, and a developer conveyance member, such as a conveyance screw, transports developer to the discharge outlet formed in the developer container.

When the amount of developer remaining in the development device is smaller than a reference amount, the conveyance screw is driven, and the developer is supplied from the developer container through the discharge outlet to the development device. When all or almost all of developer is discharged from the developer container, the developer container is replaced.

The discharge outlet is typically small to prevent scattering of developer from the discharge outlet. If developer accumulates adjacent to the discharge outlet, the possibility of clogging of the discharge outlet increases. If developer supply operation is performed while the discharge outlet is clogged, it is possible that the conveyance screw or the container body is damaged by the pressure of developer being transported.

BRIEF SUMMARY OF THE INVENTION

In view of the foregoing, one embodiment of the present invention provides a developer container that includes a container body in which a developer containing chamber for containing developer is formed, a discharge outlet formed in an inner face of the container body to discharge the developer from the developer containing chamber, a developer conveyance member provided inside the container body to transport the developer inside the developer containing chamber, a canopy disposed inside the container body and facing the discharge outlet via the developer conveyance member, a developer conveyance chamber defined by the canopy and the inner face of the container body in which the discharge outlet is formed, and a return opening formed in the canopy to return the developer from the developer conveyance chamber to the developer containing chamber. The developer conveyance member transports the developer in the developer conveyance chamber. The return opening is positioned downstream from the discharge outlet in the developer conveyance direction of the developer conveyance member. The developer conveyance member includes a first conveyance portion to transport the developer toward the discharge outlet and a second conveyance portion downstream from the first conveyance portion in a developer conveyance direction of the developer conveyance member. The second conveyance portion of the developer conveyance member transports the developer toward the return opening formed in the canopy. The developer conveyance velocity (Q2) of the second conveyance portion of the developer conveyance member is slower than a developer conveyance velocity (Q1) of the first conveyance portion.

Another embodiment provides a developer container that includes the above-described container body, the above-described discharge outlet, the above-described developer conveyance chamber, a developer conveyance member provided inside the container body to transport the developer inside the developer containing chamber, the above-described canopy, and the above-described return opening. The developer container further includes an agitator disposed inside the container body to agitate the developer by rotation, and the agitator includes a rotary shaft and a deformable blade provided to the rotary shaft.

Yet another embodiment provides a development unit that includes a development housing for containing developer, a developer bearer to carry by rotation the developer from the development housing to a latent image bearer, and the above-described developer container for containing developer supplied to the development housing.

Yet another embodiment provides a process cartridge removably installable in an image forming apparatus. The process cartridge includes the above-described development unit and the latent image bearer.

Yet another embodiment provides an image forming apparatus that includes the above-described development unit and the latent image bearer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
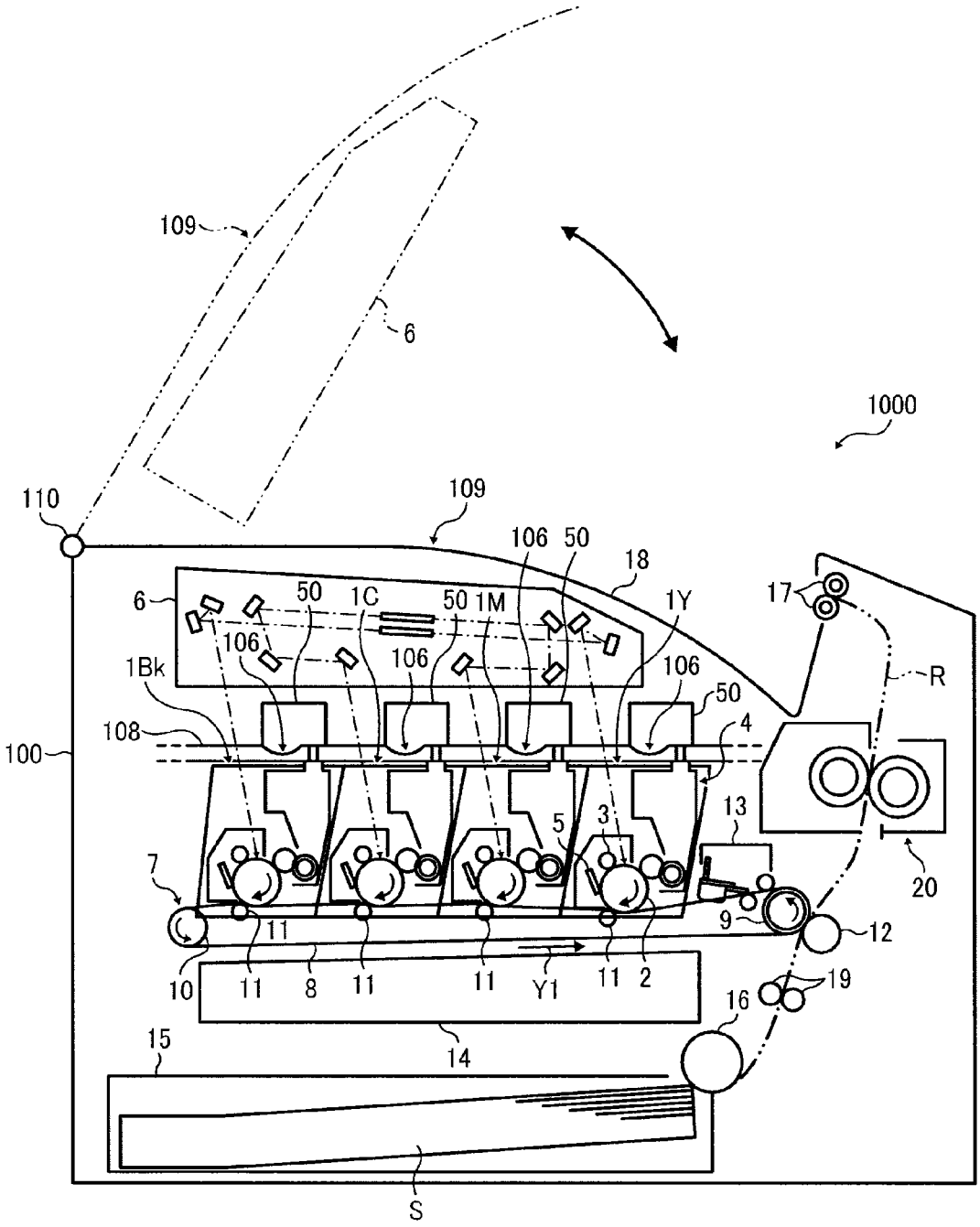
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

Referring to FIG. 1, a configuration and operation of an image forming apparatus according to an embodiment is described below.

An image forming apparatus 1000 shown in FIG. 1 can be, for example, a multicolor laser printer and includes four process units 1Y, 1M, 1C, and 1Bk removably installable in an apparatus body 100 thereof. The process units 1Y, 1M, 1C, and 1Bk respectively contain yellow (Y), magenta (M), cyan (C), and black (Bk) developer corresponding to decomposed color components of full-color images and have a similar configuration except the color of developer contained therein.

More specifically, each process unit 1 includes a drum-shaped photoreceptor 2 serving as a latent image bearer, a changing device including a changing roller 3 to charge the surface of the photoreceptor 2, a development device 4 to supply toner to a latent image formed on the photoreceptor 2, and a cleaning unit including a cleaning blade 5 to clean the surface of the photoreceptor 2.

It is to be noted that, in FIG. 1, the photoreceptor 2, the charging roller 3, the development device 4, and the cleaning blade 5 of only the process unit 1Y for yellow are given reference numerals, and reference numerals of those of other process units 1M, 1C, and 1Bk are omitted. Additionally, although one-component developer consisting essentially of toner particles is used in the present embodiment, two-component developer consisting essentially of carrier (carrier particles) and toner may be used instead.

In each process unit 1, a toner cartridge 50 serving as a developer container is provided above the development device 4. The toner cartridge 50 contains toner supplied to the development device 4. In the present embodiment, a partition 108 provided in the apparatus body 100 is disposed between the development devices 4 and the toner cartridges 50. The toner cartridges 50 are removably attached to respective container mounts 106 formed in the partition 108.

Additionally, an exposure unit 6 is provided above the toner cartridges 50 in FIG. 1 to expose to light the surface of each photoreceptor 2. The exposure unit 6 includes a light source, a polygon mirror, an f-θ lens, and reflection mirrors, and is configured to direct a laser beam onto the surface of the photoreceptor 2 according to image data.

The image forming apparatus 1000 further includes an upper cover 100 hinged to the apparatus body 100. The upper cover 109 can pivot about a fulcrum 110 and be lifted or lowered to open or close an upper opening of the apparatus body 100. The exposure unit 6 is attached to the upper cover 109. Accordingly, when the upper cover 109 is lifted, the exposure unit 6 can be moved away from the toner cartridges 50, and the toner cartridges 50 can be removed from the apparatus body 100 through the upper opening in this state.

Additionally, a transfer device 7 is provided beneath the process units 1. The transfer device 7 includes an intermediate transfer belt 8 that can be, for example, an endless belt onto and from which a toner image is transferred. The intermediate transfer belt 8 is stretched around support rollers, namely, a driving roller 9 and a driven roller 10. As the driving roller 9 rotates counterclockwise in FIG. 1, the intermediate transfer belt 8 rotates in the direction indicated by arrow Y1 shown in FIG. 1.

The image forming apparatus 1000 further includes four primary-transfer rollers 11 positioned facing the respective photoreceptors 2 via the intermediate transfer belt 8. Each primary-transfer roller 11 is pressed against an inner circumferential surface of the intermediate transfer belt 8, thus forming a primary-transfer nip between the intermediate transfer belt 8 and the corresponding photoreceptor 2. Each primary-transfer roller 11 is electrically connected to a power source and receives a predetermined amount of voltage including at least one of direct-current (DC) voltage and alternating current (AC) voltage.

Additionally, a secondary-transfer roller 12 is provided at a position facing the driving roller 9 via the intermediate transfer belt 8. The secondary-transfer roller 12 is pressed against an outer circumferential surface of the intermediate transfer belt 8, and thus a secondary-transfer nip is formed between the secondary-transfer roller 12 and the intermediate transfer belt 8. Similarly to the primary-transfer rollers 11, the secondary-transfer roller 12 is electrically connected to a power source and receives a predetermined amount of voltage including at least one of DC voltage and AC voltage.

Additionally, a belt cleaning unit 13 to clean the surface of the intermediate transfer belt 8 is provided facing a right end portion of the intermediate transfer belt 8 from the outer circumferential side in FIG. 1. A waste toner conveyance hose (tube) is connected to the belt cleaning unit 13 as well as an inlet of a waste toner container 14 provided beneath the transfer device 7.

Beneath the apparatus body 100, a sheet cassette 15 for containing sheets S of recording media, such as paper or overhead projector (OHP) films, is provided. The sheet cassette 15 is provided with a feed roller 16 to pick up and transport the sheets S from the sheet cassette 15. Additionally, a pair of discharge rollers 17 is provided in an upper portion of the apparatus body 100 to discharge the sheets S outside, and the sheets S thus discharged are stacked on a discharge tray 18 formed in the upper cover 109.

A conveyance path R is formed inside the apparatus body 100, and the sheet S is conveyed from the sheet cassette 15 to the secondary-transfer nip and further to the discharge tray 18 along the conveyance path R. Along the conveyance path R, a pair of registration rollers 19 is provided upstream from the secondary-transfer roller 12 in the direction in which the sheet S is transported (hereinafter "sheet conveyance direction"), and a fixing device 20 is provided downstream from the secondary-transfer roller 12 in that direction.

The image forming apparatus 1000 configured as described above operates as follows.

When image formation is started, the photoreceptors 2 in the respective process units 1 are rotated clockwise in FIG. 1, and the changing rollers 3 uniformly charge the surfaces of the photoreceptors 2 to a predetermined polarity. Then, the exposure unit 6 directs laser beams onto the charged surfaces of the respective photoreceptors 2 according to, for example, image data of originals read by a reading unit. Thus, electrostatic latent images are formed on the respective photoreceptors 2. More specifically, the exposure unit 6 directs the laser beams according to single color data, namely, yellow, cyan, magenta, and black color data decomposed from full-color image data to the surfaces of the photoreceptors 2. The electrostatic latent images formed on the photoreceptors 2 are developed into toner images with toner supplied by the respective development devices 4.

Meanwhile, the driving roller 9 rotates, and accordingly the intermediate transfer belt 8 rotates in the direction indicated by arrow Y1 shown in FIG. 1. The predetermined voltage (i.e., transfer bias voltage), polarity of which is the opposite that of toner, is applied to the respective primary-transfer rollers 11, thus forming transfer electrical fields in the primary-transfer nips between the primary-transfer rollers 11 and the photoreceptors 2. The transfer bias voltage may be a constant voltage or voltage controlled in constant-current control method. The transfer electrical fields generated in the primary-transfer nips transfer the toner images from the respective photoreceptors 2 and superimpose them one on another on the intermediate transfer belt 8. Thus, a multicolor toner image is formed on the intermediate transfer belt 8. After primary transfer, the cleaning blades 5 remove toner remaining on the respective photoreceptors 2.

Meanwhile, in the sheet cassette 15, the feed roller 16 rotates, thereby sending out the sheet S to the conveyance path R. Then, the registration rollers 19 forward the sheet S to the secondary-transfer nip formed between the secondary-transfer roller 12 and the intermediate transfer belt 8, timed to coincide with the multicolor toner image (superimposed single-color toner images) formed on the intermediate transfer belt 8. At that time, the transfer bias voltage whose polarity is opposite that of the toner image on the intermediate transfer belt 8 is applied to the secondary-transfer roller 12, and thus the transfer electrical field is formed in the secondary-transfer nip. The transfer electrical field generated in the secondary-transfer nip transfers the superimposed toner images from the intermediate transfer belt 8 onto the sheet S at a time. The belt cleaning unit 13 removes any toner remaining on the intermediate transfer belt 8 (i.e., waste toner) after image transfer, and the waste toner is collected in the waste toner container 14.

Subsequently, the sheet S carrying the toner image is transported to the fixing device 20, and the fixing device 20 fixes the toner image on the sheet S. The pair of discharge rollers 17 discharges the sheet S onto the discharge tray 18.

It is to be noted that, although the description above concerns multicolor image formation, alternatively, the image forming apparatus 1000 can form single-color images, bicolor images, or three-color images using one, two, or three of the four process units 1.

Figure 2:
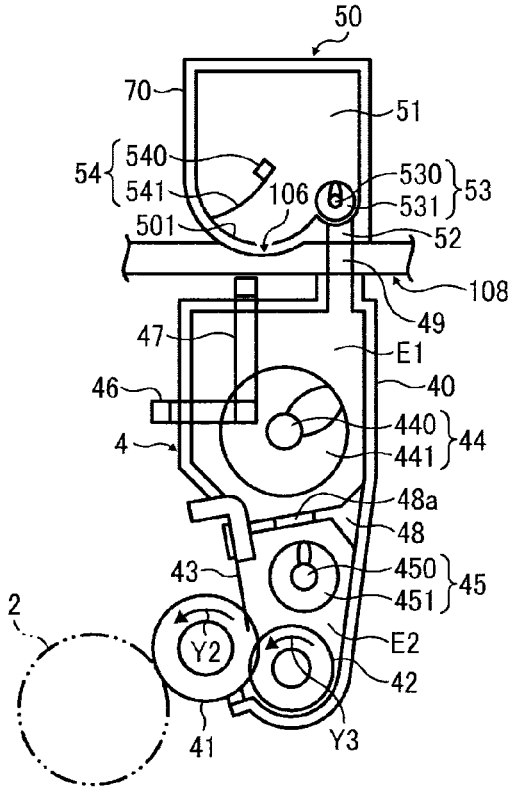
FIG. 2 is a schematic end-on axial view of a development device and a toner cartridge.

FIG. 2 is a schematic end-on axial view of the development device 4 and the toner cartridge 50.

As shown in FIG. 2, the development device 4 according to the present embodiment includes a development housing 40 for containing developer, a development roller 41 serving as a developer bearer, a supply roller 42 serving as a developer supply member to supply toner to the development roller 41, a doctor blade 43 serving as a developer regulator to adjust the amount of toner carried on the development roller 41, conveyance screws 44 and 45 serving as developer conveyance members to transport the developer (toner), and light guides 46 and 47.

A partition 48 divides an interior of the development housing 40 into a first compartment (upper compartment) E1 and a second compartment (lower compartment) E2 arranged vertically, and an opening 48*a* is formed in either end portion of the partition 48 in the direction perpendicular to the surface of the paper on which FIG. 2 is drawn. That is, the first compartment E1 and the second compartment E2 can communicate with each other via the openings 48*a* formed in the partition 48.

In the first compartment E1, the conveyance screw 44 and the two light guides 46 and 47 are provided. In the second compartment E2, the conveyance screw 45 and the supply roller 42 are provided. The development roller 41 and the doctor blade 43 are provided at an opening through which the second compartment E2 faces the photoreceptor 2.

The conveyance screw 44 includes a rotary shaft 440 and a spiral blade 441 winding around an outer circumference of the rotary shaft 440. Similarly, the conveyance screw 45 includes a rotary shaft 450 and a spiral blade 451 winding around an outer circumference of the rotary shaft 450. The conveyance screws 44 and 45 are configured to transport toner axially and in the opposite directions by rotation.

The development roller 41 includes a metal core and an electroconductive elastic layer made of, for example, rubber, overlying the metal core. In the present embodiment, for example, the metal core has an external diameter of 6 mm, and the electroconductive elastic layer has an outer diameter of 12 mm and JIS hardness (Hs) of 75. Additionally, the electroconductive elastic layer is designed to have a volume resistivity of about $10^5\Omega$ to $10^7\Omega$. For example, electroconductive urethane rubber or silicone rubber may be used for the electroconductive elastic layer. The development roller 41 rotates counterclockwise in FIG. 2 as indicated by arrow Y2 and transports the developer carried thereon to a position facing the doctor blade 43 and a position facing the photoreceptor 2.

Typically, a sponge roller can be used as the supply roller 42. The sponge roller including a metal core and semiconducting foam polyurethane adhering to the metal core is suitable. Foam polyurethane can be made semiconducting by mixing carbon therein. In the present embodiment, the metal core of the supply roller 42 has an external diameter of about 6 mm, and the sponge layer has an external diameter of about 12 mm, for example. The supply roller 42 is disposed in contact with the development roller 41. The size of the nip formed between the supply roller 42 and the development roller 41 in contact with each other is typically about 1 mm to 3 mm. In the present embodiment, the size of the nip is 2 mm, for example. Additionally, the supply roller 42 rotates counterclockwise in FIG. 2 as indicated by arrow Y3 and can transport the toner in the development housing 40 to the outer layer of the development roller 41 efficiently by rotating in the counter direction to the direction in which the development roller 41 rotates. Additionally, in the present embodiment, the ratio of rotational frequency of the supply roller 42 to that of the development roller 41 is 1 so that toner can be supplied reliably.

The doctor blade 43 can be constructed of, for example, a planar metal having a thickness of about 0.1 mm. Steel used stainless (SUS) metal may be used for the doctor blade 43. The doctor blade 43 is disposed so that its end portion contacts the surface of the development roller 41. The amount of toner carried on the development roller 41 is adjusted for stable developability and satisfactory image quality. Accordingly, in commercial products, the pressure with which the doctor blade 43 contacts the development roller 41 and the position of the regulation nip are maintained strictly. For example, the contact pressure of the doctor blade 43 against the development roller 41 is about 20 N/m to 60 N/m, and the regulation nip is positioned about 0.5±0.5 mm from the tip of the doctor blade 43. These parameters can be determined in accordance with properties of toner, the development roller, and the supply roller. For example, in the present embodiment, the doctor blade 43 is constructed of a SUS metal having a thickness of 0.1 mm, disposed in contact with the development roller 41 with a pressure of 45 N/m, and the regulation nip is positioned 0.2 mm from the tip of the doctor blade 43. The length from a fixed end of the doctor blade 43 to the free end is 14 mm to form a uniform thin toner layer on the development roller 41.

The light guides 46 and 47 are constructed of materials of good light permeability. For example, resins of high transparency, such as acrylic resin or polycarbonate can be used. Alternatively, optical glass having better optical characteristics may be used for the light guides 46 and 47. Yet alternatively, optical fibers may be used for the light guides 46 and 47. In this case, design flexibility of the light path formed with the light guides 46 and 47 can be improved.

An end of each of the light guides 46 and 47 is exposed outside the development housing 40. While the process unit 1 is in the apparatus body 100, the exposed end portions of the light guides 46 and 47 respectively face a light-emitting element and a light-receiving element of a toner amount detector provided to the apparatus body 100. With the light-emitting element and the light-receiving element facing the end portions of the light guides 46 and 47, respectively, a light path for guiding light from the light-emitting element to the light-receiving element through the light guides 46 and 47 can be formed. That is, the light emitted from the light-emitting element is guided to the development housing 40 by the light guide 46 and guided further to the light-receiving element by the light guide 47. The other end of the light guide 46 and the other end of the light guide 47 are disposed inside the development housing 40 and face each other across a clearance of a predetermined or given size.

The toner cartridge 50 includes a container body 70 in which a developer chamber 51 is formed, a conveyance screw 53, and an agitator 54. The agitator 54 agitates the toner inside the developer chamber 51, and the conveyance screw 53 transports the toner to a discharge outlet 52 formed in the container body 70. The discharge outlet 52 is positioned in a lower portion of the developer chamber 51. In the container mounts 106 formed in the partition 108 to which the respective toner cartridges 50 are attached, supply inlets 49 are formed to be connected to the discharge outlets 52 of the toner cartridges 50.

The conveyance screw 53 includes a rotary shaft 530 and a spiral blade 531 winding around an outer circumference of the rotary shaft 530. The agitator 54 includes a rotary shaft 540 parallel to the rotary shaft 530 of the conveyance screw 53 and a deformable planar blade 541 provided to the rotary shaft 540. For example, the blade 541 of the agitator 54 can be a flexible material such as polyethylene terephthalate film. Additionally, when a bottom face 501 of the developer chamber 51 is curved into an arc in conformity with a locus of rotation of the blade 541 as shown in FIG. 2, the amount of toner that is not moved but remains inside the developer chamber 51 can be reduced.

It is to be noted that, although the toner cartridge 50 is designed to be installed and removed from the apparatus body 100 independently in the present embodiment, it is not essential to aspects of the present invention. For example, the toner cartridge 50 may be united with at least one of the development device 4, the photoreceptor 2, and the like into a single modular unit to be replaced entirely. Alternatively, the toner cartridge 50 and the development device 4 may be united into a single development unit to be replaced entirely. In such a configuration, the partition 108 can be omitted and the container mount 106 can be formed not in the partition 108 but in an upper portion of the development device 4 so that the toner cartridge 50 is directly connected to the upper portion of the development device 4.

Development operation of the above-described development device 4 is described below with reference to FIG. 2.

When the development roller 41 and the supply roller 42 start rotating in response to a start command, the supply roller 42 supplies toner to the surface of the development roller 41. While the toner carried on the development roller 41 passes through a nip between the development roller 41 and the doctor blade 43, the amount of the toner is adjusted. Simultaneously, the toner is charged through friction. When the toner reaches the position facing the photoreceptor 2 (i.e., a development range), the toner electrostatically moves to the electrostatic latent image formed on the photoreceptor 2, thus developing it into a toner image.

Next, supply of toner to the development device 4 is described in further detail below.

When the amount of toner inside the development housing 40 falls to or below a reference amount, toner is supplied to the development device 4. Specifically, while the amount of toner inside the development housing 40 is greater than the reference amount, toner is present between the ends of the light guides 46 and 47 facing each other, blocking the light path between them. Accordingly, the light-receiving element does not receive light. When the amount of toner remaining inside the development housing 40 falls below the reference amount as the toner is consumed in image development, no toner is present between the ends of the light guides 46 and 47. Accordingly, toner can be transmitted from the light guide 46 to the light guide 47. In response to detection of transmission of light, a toner supply command is generated.

Upon the toner supply command, the conveyance screw 53 inside the toner cartridge 50 rotates. Then, toner is conveyed to the discharge outlet 52 and supplied through the discharge outlet 52 to the first compaitment E1 inside the development housing 40. Additionally, in the present embodiment, the agitator 54 starts rotating simultaneously with rotation of the conveyance screw 53. As the agitator 54 rotates, toner inside the toner cartridge 50 is agitated and conveyed toward the conveyance screw 53. When the amount of toner inside the development housing 40 is increased to or greater than the reference amount with the toner supply operation, the light path between the light guides 46 and 47 is blocked, and the conveyance screw 53 and the agitator 54 are stopped. Thus, toner supply is completed.

Meanwhile, when toner is thus supplied, in the development housing 40, the conveyance screws 44 and 45 start rotating and conveying toner in the opposite directions in the first and second compartments E1 and E2, respectively. When the toner reaches downstream end portions in the first and second compartments E1 and E2 in the direction which the toner is conveyed (hereinafter "toner conveyance direction"), the toner is forwarded to the other compartment E1 or E2 through the opening 48*a* formed in the either end portion of the partition 48. Then, the toner is conveyed in the compartment E1 or E2 toward the opposite end and returned through the opening 48 to the compartment E1 or E2 where the toner is present originally. By repeating this operation, the toner can be circulated between the first compartment E1 and the second compartment E2, and the supplied toner can be mixed with the toner existing in the development housing 40.

Thus, while toner is circulated inside the development housing 40, the ratio of fresh toner in the toner inside the development housing 40 can become uniform, thus reducing color unevenness and scattering of toner in the background of output images.

Figure 3:
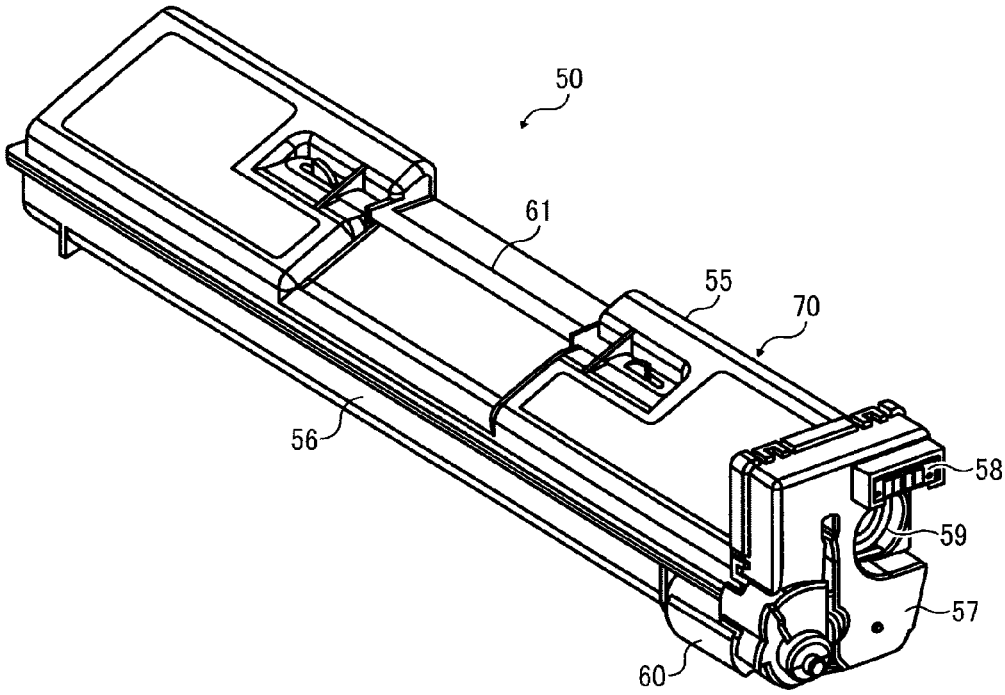
FIG. 3 illustrates an exterior of the toner cartridge.

FIG. 3 illustrates an exterior of the toner cartridge 50.

As shown in FIG. 3, the container body 70 of the toner cartridge 50 includes an upper case 55 and a lower case 56. The conveyance screw 53 and the agitator 54 are contained in a compartment formed with the upper case 55 and the lower case 56 connected together. The upper case 55 and the lower case 56 can be welded together employing vibration welding, ultrasonic welding, or the like; or bonded together using double-sided adhesive tape, adhesive, or the like.

A gear cover 57 is provided to an end face (on the right in FIG. 3) at an end in the longitudinal direction of the upper and lower cases 55 and 56. Multiple gears are contained inside the gear cover 57 to transmit driving force to the conveyance screw 53 and the agitator 54 that rotate in the container body 70. With the gear cover 57, users or maintenance persons can be prevented from contacting the gears accidentally in replacement of the toner cartridge 50.

Additionally, a data storage medium 58 is provided to the gear cover 57. The data storage medium 58 can store data, such as the color and the amount of toner, relating to the toner cartridge 50. The data storage medium 58 includes multiple connection terminals. When these connection terminals are connected to a data reader provided to the apparatus body 100, the data in the data storage medium 58 can be read or updated.

Additionally, a cap 59 to cap a supply inlet and a shutter 60 to open and close the discharge outlet 52 are provided in the longitudinal end portion of the container body 70 on the same side as the gear cover 57. The cap 59 is designed to prevent leakage of toner from the supply inlet after toner is supplied to the toner cartridge 50 through the supply inlet. The shutter 60 can pivot relative to the container body 70, thereby opening or closing the discharge outlet 52.

Additionally, a handle 61 is provided to an upper face of a center portion in the longitudinal direction of the container body 70. The handle 61 can be formed with a flexible material such as polypropylene or polyethylene, for example. In replacement of the toner cartridge 50, users can install or remove the toner cartridge 50 from the apparatus body 100 easily gripping the handle 61.

Figure 4:
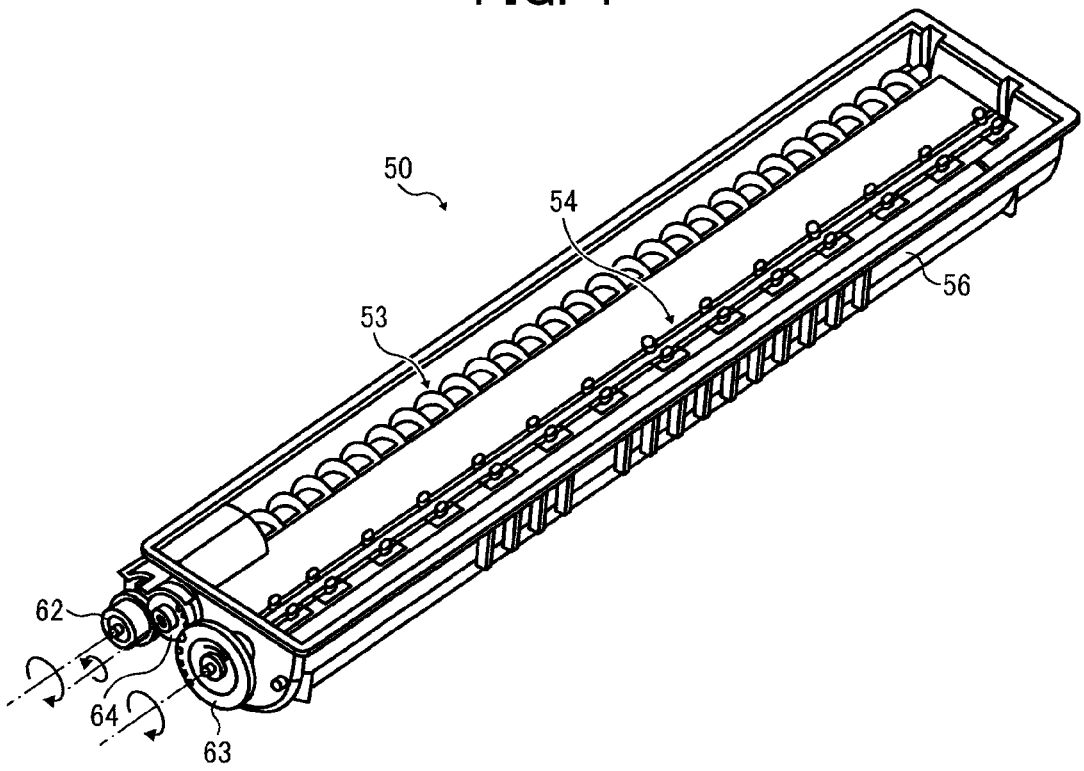
FIG. 4 is a perspective view illustrating the toner cartridge from which an upper case and a gear cover are removed.

FIG. 4 is a perspective view illustrating the toner cartridge 50 from which the upper case 55 and the gear cover 57 are removed.

In FIG. 4, reference numerals 62, 63, and 64 represent the respective gears contained in the gear cover 57. The gear 62 is provided to the rotary shaft 530 (shown in FIG. 2) of the conveyance screw 53 and hereinafter also referred to as "conveyance driving gear 62". The gear 63 is provided to the rotary shaft 540 of the agitator 54 and hereinafter referred to as "agitator driving gear 63". The gear 64 engages the conveyance driving gear 62 as well as the agitator driving gear 63 to transmit a rotation torque and hereinafter also referred to as "torque transmission gear 64".

Additionally, bearings are provided to portions where the rotary shafts 530 and 540 penetrate the lower case 56 to support the rotary shafts 530 and 540 and prevent leakage of toner therefrom, thus serving as sealing members. For example, so-called G-rings, which are rubber sealing rings shaped like a character "G" in cross section, may be used as such sealing members. G-rings press against shafts in the radial direction with an elastic sealing rip formed continuously with an inner circumference of a ring body. Alternatively, sponge having a relatively high degree of hardness and a resin bearing such as polyacetal (POM) can be used in combination. The cost of such sealing members can be lower than that of G-rings.

In the present embodiment, when the toner cartridge 50 is installed in the apparatus body 100, the conveyance driving gear 62 engages a driving gear provided to the apparatus body 100. When the driving gear of the apparatus body 100 rotates in this state, the conveyance driving gear 62, the agitator driving gear 63, and the torque transmission gear 64 rotate in the directions indicated by respective arrows shown in FIG. 4, thus rotating the conveyance screw 53 and the agitator 54.

Descriptions are given below of a toner cartridge according to a first embodiment.

Figure 5:
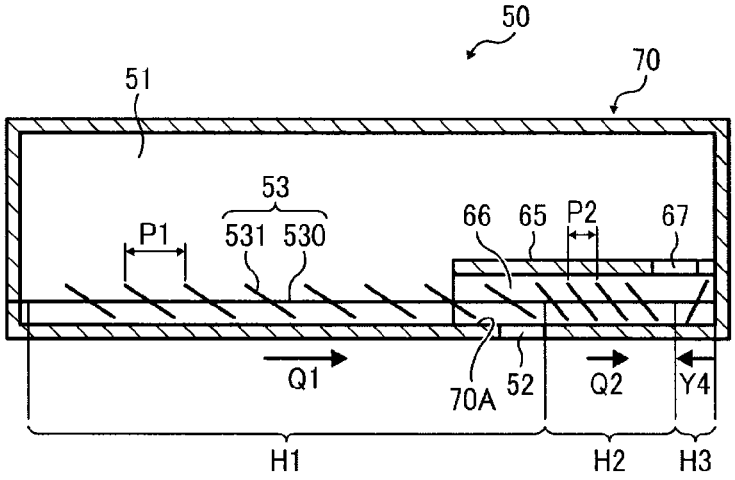
FIG. 5 is a cross-sectional view of a toner cartridge according to a first embodiment as viewed from a front side.

FIG. 5 is a cross-sectional view of the toner cartridge according to the first embodiment as viewed from a front side.

Figure 10:
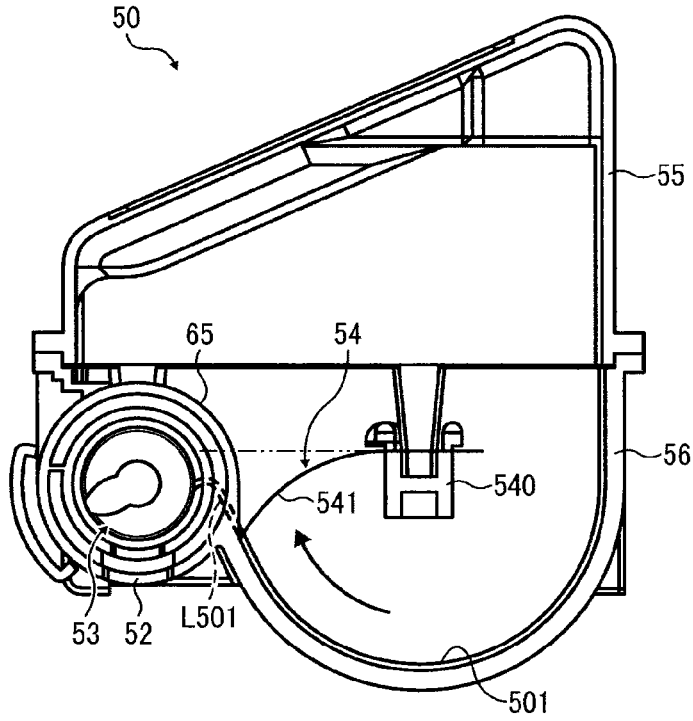
FIG. 10 illustrates a cross section (along line Y-X in FIG. 8) of an end portion of the toner cartridge where the canopy is provided.

Referring to FIG. 5, the toner cartridge 50 includes a canopy 65 disposed inside the container body 70 to face the discharge outlet 52. As shown in FIG. 10, the canopy 65 is half-round or semicylindrical. A part of the conveyance screw 53 is inserted between the canopy 65 and an inner bottom face 70A of the container body 70. Thus, the canopy 65 and the inner bottom face 70A of the container body 70 define a developer conveyance chamber 66 in which the conveyance screw 53 transports toner.

A return opening 67 is formed in the canopy 65 at a position downstream from the discharge outlet 52 in the toner conveyance direction by the conveyance screw 53 (indicated by arrows Q1 and Q2). Additionally, an end face of the canopy 65 on the side of the return opening 67 contacts an inner face of the container body 70. Thus, the developer conveyance chamber 66 is closed at this end of the canopy 65.

At least one of pitch and direction of the spiral blade 531 of the conveyance screw 53 is different among a first portion H1 extending from the left end in FIG. 5 to a downstream end of the discharge outlet 52 in the toner conveyance direction, a second portion H2 extending from the downstream end of the discharge outlet 52 to the return opening 67, and a third portion H3 extending from the return opening 67 to the right end in FIG. 5.

It is to be noted that, in FIG. 5, relative conveyance velocities of the first and second portions H1 and H2 are represented with the size of arrows Q1 and Q2 and hereinafter also referred to as "toner conveyance velocity Q1" and "toner conveyance velocity Q2", respectively.

Specifically, although the direction of the spiral blade 531 is identical between the first and second portions H1 and H2, a pitch P2 of the spiral blade 531 in the second portion H2 is shorter than a pitch P1 in the first portion H1 (P1>P2). With this configuration, the toner conveyance velocity Q2 of the second portion H2 is slower than a toner conveyance velocity Q1 of the first portion H1 (Q1>Q2). In the third portion H3, the direction of the spiral blade 531 is opposite that in the first and second portions H1 and H2. Therefore, the third portion H3 transports toner in the direction indicated by arrow Y4, which is opposite the toner conveyance direction (indicated by arrows Q1 and Q2) of the first and second portions H1 and H2.

It is to be noted that, in the description below, "toner conveyance direction of the conveyance screw 53" means the toner conveyance direction of not the third portion H3 but the first and second portions H1 and H2 unless otherwise specified.

Next, toner conveyance by the conveyance screw 53 is described with reference to FIG. 5.

When the conveyance screw 53 rotates, instructed to supply toner, the first portion H1 of the conveyance screw 53 transports toner downstream in the developer chamber 51. Then, the toner transported by the first portion H1 enters the developer conveyance chamber 66. When the toner reaches the discharge outlet 52, the toner is supplied through the discharge outlet 52 to the development device 4 (shown in FIG. 2).

The toner that is not discharged from the discharge outlet 52 is transported by the second portion H2 further downstream. Since the toner conveyance velocity Q2 of the second portion H2 is slower than the toner conveyance velocity Q1 of the first portion H1, the toner is more likely to remain in the second portion H2, and toner pressure increases on the downstream side of the discharge outlet 52. Consequently, the toner tends to move to an area where pressure is lower, and discharge of toner (toner supply) through the discharge outlet 52 can be facilitated.

Additionally, the canopy 65 provided above the discharge outlet 52 can prevent the toner in the developer chamber 51 from flowing to the discharge outlet 52 in an undesirable manner. Thus, the amount of toner discharged from the discharge outlet 52 can be stable. Additionally, since the canopy 65 extends entirely in the area where the second portion H2 transports toner, load applied from toner inside the developer chamber 51 to the toner being transported by the second portion H2 can be alleviated. Accordingly, even when the amount of toner inside the developer chamber 51 is smaller and the load is smaller, the effects on the second portion H2 can be restricted. In other words, the amount of toner discharged through the discharge outlet 52 can be stabilized because fluctuations in the toner pressure in the second portion H2 can be restricted.

The toner that is not discharged from the discharge outlet 52 is transported by the second portion H2 to the return opening 67. Further, toner is returned to the second portion H2 by the third portion H3 positioned downstream from the second portion H2 in the toner conveyance direction indicated by arrow Q2. Consequently, the toner transported by the second portion H2 and the toner transported by the third portion H3, which are transported in the opposite directions, merge together adjacent to the return opening 67, and the toner is pushed out the developer conveyance chamber 66 through the return opening 67 to the developer chamber 51.

It is to be noted that toner can be pushed out through the return opening 67 with the pressure exerted by the toner accumulating adjacent to the return opening 67 even if the third portion H3 is not provided. Providing the third portion 113 can facilitate discharge of toner through the return opening 67. Returning toner to the developer chamber 51 by the third portion H3 is advantageous also in that toner can be inhibited from aggregating in an end portion of the developer conveyance chamber 66 on the side of the third portion H3.

Figure 6:
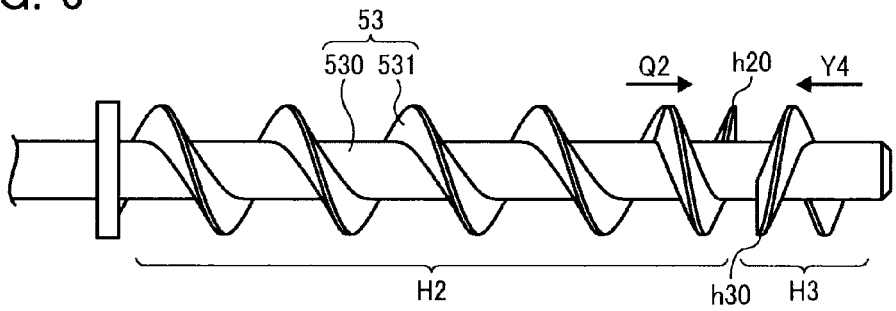
FIG. 6 illustrates an end portion of a conveyance screw as viewed in a direction perpendicular to its axial direction.
Figure 7:
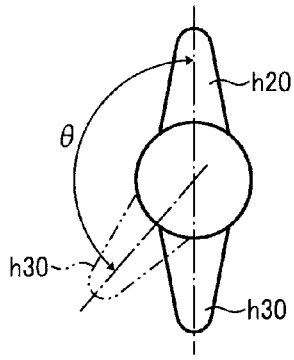
FIG. 7 is an end-on cross-sectional view of the conveyance screw shown in FIG. 6.

To further facilitate discharge of toner through the return opening 67, as shown in FIGS. 6 and 7, it is desirable that a downstream blade end h20 (in the toner conveyance direction indicated by arrow Q2) of the spiral blade 531 in the second portion H2 be different in rotational phase from a blade end h30 of the spiral blade 531 in the third portion H3. The end h30 is on the side closer to the second portion H2 and is a downstream end of the third portion H3 in the direction indicated by arrow Y4 in which the third portion H3 transports toner.

With a different θ in rotational phase between the blade ends h20 and h30 of the second and third portions H2 and H3, a time lag can be provided between conveyance of toner to the downstream end h20 and that to the end h30. As a result, compression of the toner merging together adjacent to the return opening 67 can be prevented, thus securing fluidity of toner adjacent to the return opening 67. It is to be noted that, in the configuration shown in FIGS. 6 and 7, the difference θ in rotational phase between the downstream end h20 and the end 30*h* can be up to 180°.

Next, agitation of toner by the agitator 54 is described with reference to FIGS. 8 through 11.

Figure 8:
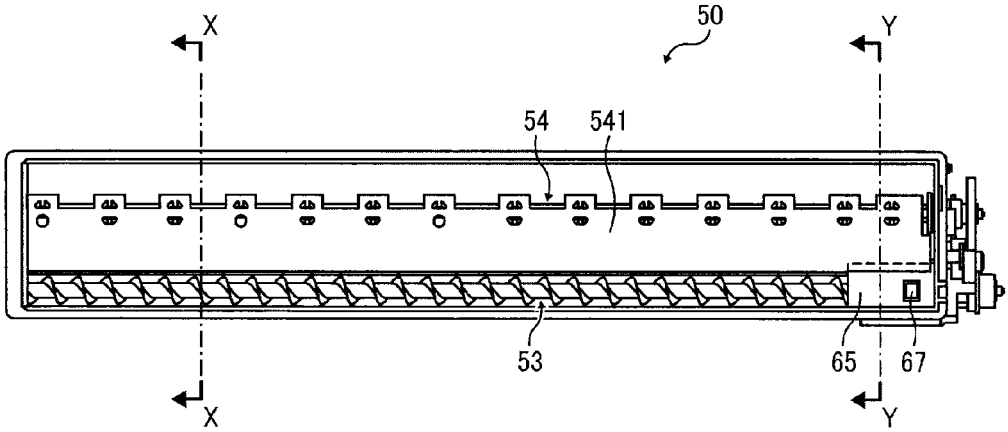
FIG. 8 is a plan view illustrating the toner cartridge according to the first embodiment from which the upper case and the gear cover are removed.
Figure 9:
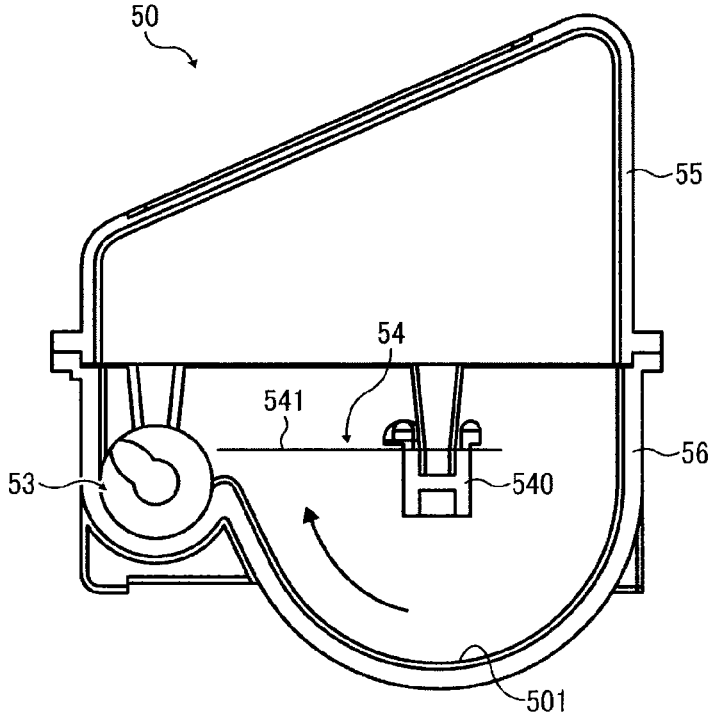
FIG. 9 illustrates a cross section (along line X-X in FIG. 8) of an end portion of the toner cartridge where a canopy 65 is not provided.
Figure 11:
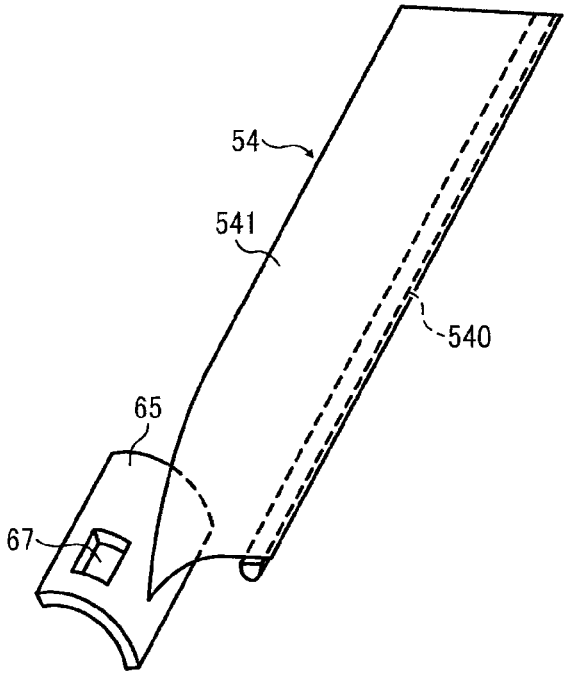
FIG. 11 is a perspective view of an agitator being agitating developer.

FIG. 8 is a plan view illustrating the toner cartridge 50 according to the first embodiment from which the upper case 55 and the gear cover 57 are removed. FIG. 9 illustrates a cross section (along line X-X in FIG. 8) of an end portion of the toner cartridge 50 where the canopy 65 is not provided. FIG. 10 illustrates a cross section (along line Y-Y in FIG. 8) of the end portion of the toner cartridge 50 where the canopy 65 is provided. FIG. 11 is a perspective view of the agitator 54 being agitating developer (i.e., toner).

The agitator 54 agitates by rotation the toner returned to the developer chamber 51 through the return opening 67 formed in the canopy 65. While agitating toner, the blade 541 of the agitator 54 contacts the bottom face 501 of the developer chamber 51 and deforms.

Subsequently, in the end portion shown in FIG. 9, the deformed blade 541 reverts to the original state (flat state) after a tip of the blade 541 passes by the bottom face 501. By contrast, in the end portion shown in FIG. 10, the blade 541 is kept deformed after the tip of the blade 541 passes by the bottom face 501 because the blade 541 is in contact with the canopy 65. Therefore, as shown in FIG. 11, the blade 541 of the agitator 54 temporarily becomes flat in one end portion with the other end kept deformed. Thus, the blade 541 is twisted at a center position in the longitudinal direction of the blade 541. When the agitator 54 rotates further and reaches a position where the tip of the blade 541 does not contact the canopy 65 in the end portion shown in FIG. 10, the deformed blade 541 reverts to the original state (flat state). Thus, in the present embodiment, reversion of the blade 541 of the agitator 54 to the flat state is delayed in the end portion with the canopy 65 from that in the other end portion without the canopy 65.

Additionally, the amount of deformation of the blade 541 is greater in the end portion with the canopy 65 than that in the end portion without the canopy 65. This is caused by relative positions of the rotary shaft 540 of the agitator 54, a surface of the canopy 65, and the bottom face 501 (indicated by broken lines L501 shown in FIG. 10) in the end portion without the canopy 65. More specifically, as shown in FIG. 10, the distance from the surface of the canopy 65 to the rotary shaft 540 of the agitator 54 is shorter than the distance from the bottom face 501 to the rotary shaft 540 of the agitator 54 in the end portion without the canopy 65. Additionally, since the return opening 67 is adjacent to the downstream end portion of the canopy 65 in the toner conveyance direction, the amount of deformation of the blade 541 is greater in the area corresponding to the return opening 67 than the area upstream therefrom.

As described above, the present embodiment is configured such that the amount of deformation of the blade 541 of the agitator 54 is increased in the area corresponding to the return opening 67, and toner agitation effects can be increased particularly adjacent to the return opening 67. Therefore, accumulation of toner adjacent to the return opening 67 can be inhibited, thus facilitating discharge of toner through the return opening 67. Additionally, since reversion of the blade 541 in the end portion where the canopy 65 is provided is delayed from that in the end portion where the canopy 65 is not provided, the toner returned through the return opening 67 can be moved upstream in the toner conveyance direction. This configuration can inhibit increases in toner pressure adjacent to the return opening 67, thus further facilitating discharge of toner through the return opening 67.

Figure 12:
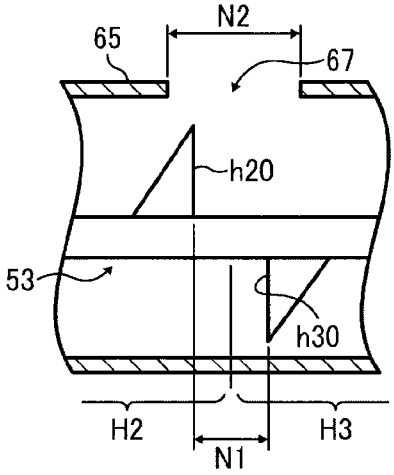
FIG. 12 illustrates relations between a size of a return opening and an interval of blades of a developer conveyance member.

FIG. 12 illustrates relations between a size of the return opening 67 and an interval between blades of the developer conveyance member 53.

In FIG. 12, reference character N1 represents an interval between the downstream end h20 of the second portion H2 of the developer conveyance member 53 and the end h30 of the third portion H3 in the axial direction of the developer conveyance member 53, and reference character N2 represents the length of the return opening 67 in the axial direction of the developer conveyance member 53. In the configuration shown in FIG. 12, the interval N1 between the blades of the developer conveyance member 53 is smaller than the length N2 of the return opening 67 in the axial direction (N1<N2), which is advantageous in that the downstream end h20 and the end h30 can be disposed within the area facing the return opening 67. Accordingly, a sufficient capability of conveying toner from the downstream end h20 and the end h30 to the return opening 67 can be secured. This configuration can facilitate discharge of toner through the return opening 67.

Figure 13:
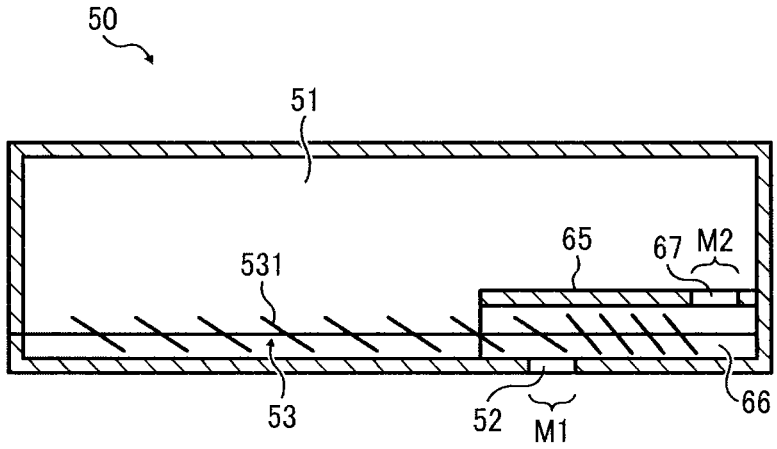
FIG. 13 illustrates relations between the size of a return opening and a size of a discharge outlet.

FIG. 13 illustrates relations between the size of the return opening 67 and the size of the discharge outlet 52.

In the configuration shown in FIG. 13, an opening area M1 of the discharge outlet 52 equals or is greater than an opening area M2 of the return opening 67 (M1≥M2). This configuration can facilitate discharge of toner through the discharge outlet 52, thus stabilizing the amount of toner supplied to the development device 4.

Action and effects of the toner cartridge according to the present embodiments are described below in comparison with a comparative example. An experiment was performed for comparing the amount of toner supply in the configuration shown in FIG. 5 (embodiment) with that in the comparative example shown in FIG. 14.

A toner cartridge 500 according to the comparative example is described below.

It is to be noted that, although suffix X is added to reference numerals of components shown in FIG. 14 to indicate that they are components of the comparative example, configuration of the toner cartridge 500 is similar to that of the above-described embodiment other than differences described below.

Figure 14:
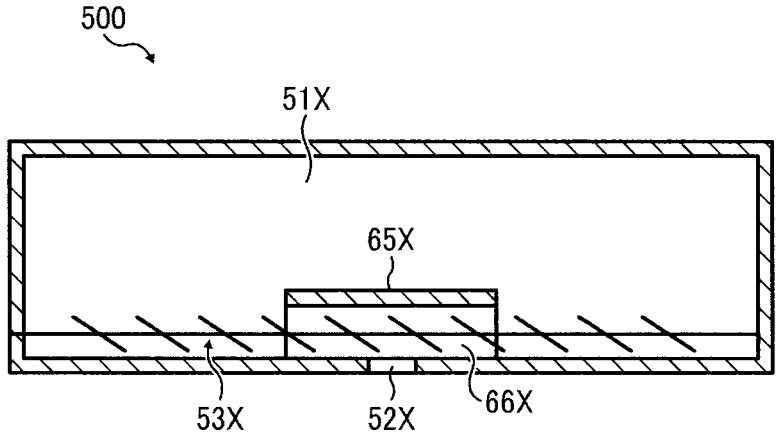
FIG. 14 illustrates a cross section from a front side of a toner cartridge according to a comparative example.

Referring to FIG. 14, in the toner cartridge 500, a discharge outlet 52X is positioned in an axial center portion of a conveyance screw 53X, and a canopy 65X is disposed facing the discharge outlet 52X. In the comparative example, the return opening 67 is not provided. Instead, the canopy 65X is not present in the downstream end portion in the toner conveyance direction, securing an opening for returning toner from a developer conveyance chamber 66X to a developer chamber 51X. Additionally, the pitch of the blade of the conveyance screw 53X is constant over the entire axial length of the conveyance screw 53X. In other words, the conveyance screw 53X is designed to transport toner at an identical or similar velocity over the entire axial length. The conveyance screw 53X has an external diameter of 12 mm. In the experiment, the conveyance screw 53X was rotated at a velocity of 100 revolutions per minute (rpm).

By contrast, the conveyance screw 53 (shown in FIG. 5) according to the above-described embodiment includes the first portion H1, the second portion H2 whose toner conveyance velocity Q2 is slower than the toner conveyance velocity Q1 of the first portion H1, and the third portion H3 to transport toner in the direction opposite to the toner conveyance direction of the first and second portions H1 and H2. Additionally, the return opening 67 is formed in the canopy 65, and the end of the canopy 65 on the side of the return opening 67 is connected to the inner face of the toner cartridge 50. That is, the developer conveyance chamber 66 is closed at the axial end of the conveyance screw 53. The conveyance screw 53 used in the experiment has an external diameter of 12 mm and a velocity of 100 rpm similarly to the comparative conveyance screw 53X. Additionally, in the experiment, the pitch of the spiral blade 531 of the first and second portions H1 and H2 were 11 mm and 6 mm, respectively.

In the experiment, 50 grams of toner was contained in the toner cartridge 50 shown in FIG. 5 and the toner cartridge 500 shown in FIG. 14, and the amount of toner discharged (i.e., toner supply amount) through the discharge outlets 52 and 52X in each toner supply operation was measured. It is to be noted that 50 grams of toner is about one third of the capacity (e.g., 130 grams) of the toner cartridge 50 or 500.

Figure 15:
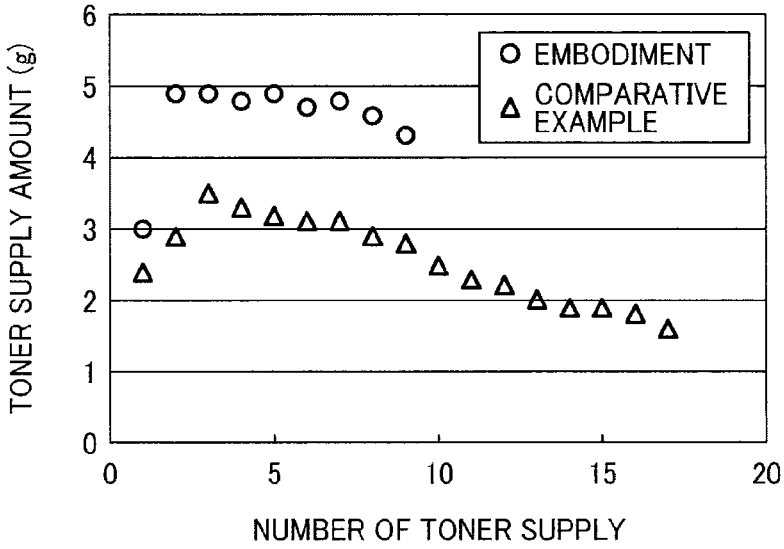
FIG. 15 is a graph illustrating results of toner supply experiment using configurations shown in FIGS. 5 and 14.

FIG. 15 illustrates the results of the experiment.

Specifically, FIG. 15 illustrates changes in the amount of toner supplied by the toner cartridge 50 and that by the comparative toner cartridge 500 while the supply operation is repeated. In FIG. 15, the circles represent toner supply amount in the toner cartridge 50, and triangles represent that in the comparative toner cartridge 500. It is to be noted that driving of the conveyance screw 53 or 53X was started before toner was sufficiently supplied thereto in the experiment, and accordingly the toner supply amount was smaller than a specified amount in the first supply operation in the toner cartridge 50 and first and second supply operations in the comparative toner cartridge 500. Therefore, in the results shown in FIG. 15, the embodiment and the comparative example are compared regarding the toner supply amount in toner supply operations after the toner supply amount reaches the maximum (second supply operation in the embodiment and third supply operation in the comparative example).

As shown in FIG. 15, in the comparative example, the amount of toner supplied in each supply operation was smaller than that in the configuration according to the above-described embodiment, and the toner supply amount decreased gradually. It can be assumed that the toner supply amount in the comparative example decreases as the supply operation is repeated because the amount of toner supplied through the discharge outlet 52X is affected by the amount of toner remaining in the toner cartridge 500.

Figure 16A:
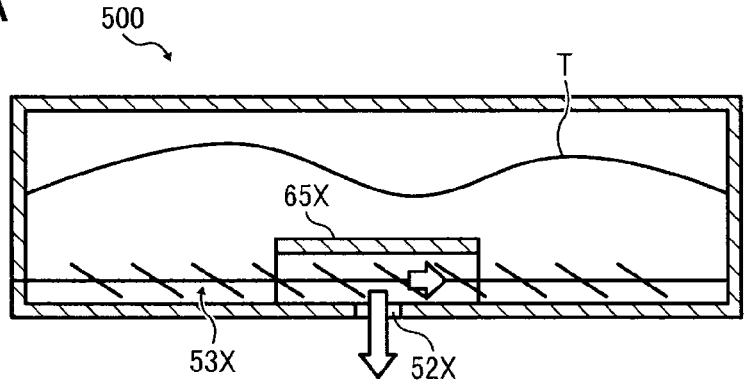
FIGS. 16A and 16B illustrate toner supply operation of the toner cartridge according to the comparative example.
Figure 16B:
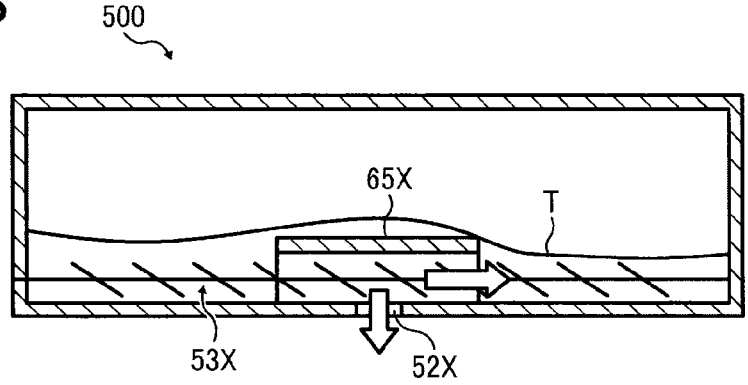

Specifically, referring to FIG. 16A, while the amount of toner T remaining in the comparative toner cartridge 500 is sufficient, the toner pressure downstream from the discharge outlet 52X in the toner conveyance direction is higher, and the toner pressure inhibits the toner T from moving downstream. Accordingly, while the amount of remaining toner T is sufficient, toner can be discharged easily, thus securing a certain amount of toner supplied through the discharge outlet 52. However, when the amount of remaining toner T is small as shown in FIG. 16B, the toner pressure downstream from the discharge outlet 52X in the toner conveyance direction is lower, and toner can move downstream easily. Accordingly, the amount of toner discharged through the discharge outlet 52X decreases. Then, as the amount of remaining toner decreases, the toner pressure downstream from the discharge outlet 52X in the toner conveyance direction decreases, and the amount of toner discharged through the discharge outlet 52X decreases.

By contrast, since the toner conveyance velocity Q2 of the second portion H2 is slower than the toner conveyance velocity Q1 of the first portion H1 in the embodiment shown in FIG. 5, the toner is more likely to remain downstream from the discharge outlet 52, and toner pressure downstream from the discharge outlet 52 can be increased. Therefore, in the above-described embodiment, even when the amount of remaining toner is small, the drop in the toner pressure downstream from the discharge outlet 52 can be restricted, and decreases in the toner supply amount can be limited.

Thus, the toner supply amount is less affected by the amount of toner in the toner cartridge 50, and toner supply can be reliable. Further, in the above-described embodiment, the toner pressure downstream from the discharge outlet 52 can be kept higher than that in the comparative example, and accordingly the toner supply amount in each supply operation can be greater. Thus, a necessary amount of toner can be supplied with smaller number of times of toner supply operation. Thus, total time of toner supply operations can be reduced, and waiting time of image formation caused by toner supply operation can be reduced.

As described above, since the return opening 67 is formed in the canopy 65 of the toner cartridges (developer containers) 50 according to the above-described embodiments, toner in the developer conveyance chamber 66 can be returned to the developer chamber 51 through the return opening 67 in case the discharge outlet 52 is clogged. With this configuration, even if the discharge outlet 52 is clogged, increases in the toner pressure as well as the load to the conveyance screw 53, the agitator 54, or the container body 70 can be restricted. Thus, damage to those components can be prevented or reduced.

It is to be noted that, the discharge outlet 52 can be clogged if developer is supplied to the development device 4 due to malfunction in a control system while the amount of developer remaining the development device 4 is sufficient. The above-described features of the embodiment can reduce possibility of clogging of the discharge outlet 52 in such cases.

The possibility of damage to components is not limited to a developer container that is independently replaced, and can happen also in configurations in which the developer container and the development device are replaceable as a single unit. With the above-described features of the embodiment, damage to components can be prevented also in such configurations.

Additionally, slowing the developer conveyance velocity downstream from the discharge outlet 52 can increase the toner pressure downstream from the discharge outlet 52, thus facilitating discharge of developer through the discharge outlet 52. This feature is advantageous also in that, even when the amount of remaining toner is small, drop in the toner pressure downstream from the discharge outlet 52 can be inhibited, securing reliable toner supply through the discharge outlet 52.

Additionally, the amount of deformation of the blade 541 of the agitator 54 due to rotation of the agitator 54 is increased in the area facing the return opening 67, and toner agitation effects can be increased adjacent to the return opening 67. Accordingly, accumulation of toner adjacent to the return opening 67 can be inhibited. With this configuration, even if the discharge outlet 52 is clogged, increases in the load resulting from increases in the toner pressure can be inhibited because the toner in the developer conveyance chamber 66 can be returned through the return opening 67.

Descriptions are given below of a toner cartridge according to a second embodiment.

Figure 17:
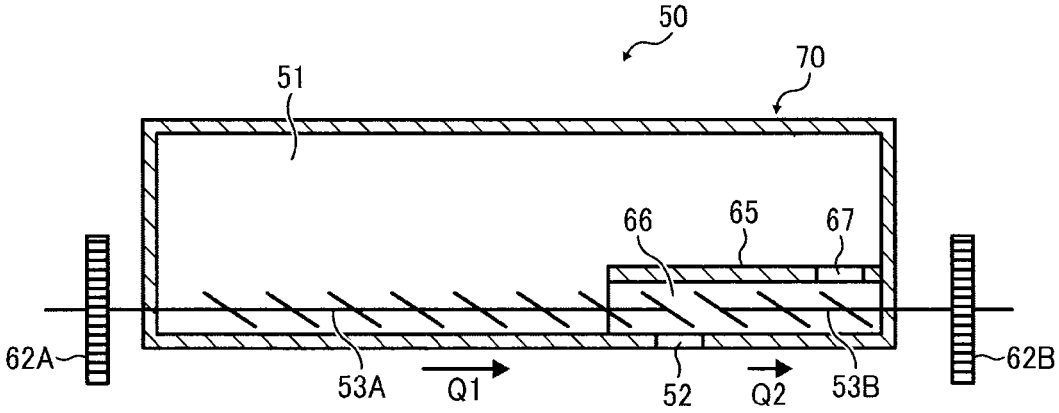
FIG. 17 is a cross-sectional view of a toner cartridge according to another embodiment.

FIG. 17 is a cross-sectional view of the toner cartridge according to the second embodiment as viewed from a front side.

The toner cartridge 50 shown in FIG. 17 includes separate conveyance screws 53A and 53B to transport toner. In FIG. 17, the conveyance screw 53A on the left extends from the left end of the container body 70 to the discharge outlet 52 whereas the conveyance screw 53B on the right extends from the discharge outlet 52 to the right end of the container body 70. Hereinafter the conveyance screws 53A and 53B are referred to as first and second conveyance screws 53A and 53B, respectively.

In FIG. 17, the left end portion of the first conveyance screw 53A and the right end portion of the second conveyance screw 53B project outside the container body 70, and conveyance driving gears 62A and 62B are respectively provided to the projecting end portions of the first and second conveyance screws 53A and 53B to transmit driving force thereto. In the present embodiment, the first and second conveyance screws 53A and 53B are rotated at different velocities by controlling the conveyance driving gears 62A and 62B. Specifically, the rotational velocity of the second conveyance screw 53B is slower than that of the first conveyance screw 53A so that the toner conveyance velocity Q2 of the second conveyance screw 53B is slower than the toner conveyance velocity Q1 of the first conveyance screw 53A (Q1>Q2). In this configuration, pitch of the blade of the conveyance screws 53A and 53B are similar or identical. Other than the difference described above, the configuration of the second embodiment is similar to that of the first embodiment Next, toner conveyance according to the second embodiment is described below.

When the first and second conveyance screws 53A and 53B rotate, instructed to supply toner, the first conveyance screw 53A transports toner downstream in the developer chamber 51. Then, the toner transported by the first conveyance screw 53A enters the developer conveyance chamber 66. When the toner reaches the discharge outlet 52, the toner is supplied through the discharge outlet 52 to the development device 4 (shown in FIG. 2).

The toner that is not discharged from the discharge outlet 52 is transported by the second conveyance screw 53B further downstream. Since the toner conveyance velocity Q2 of the second conveyance screw 53B is slower than the toner conveyance velocity Q1 of the first conveyance screw 53A, the toner is more likely to remain in the area where the second conveyance screw 53B transports toner, and toner pressure increases on the downstream side of the discharge outlet 52. Consequently, the toner tends to escape to an area where pressure is lower, and discharge of toner (toner supply) through the discharge outlet 52 can be facilitated. In other words, the first and second conveyance screws 53A and 53B in the second embodiment have capabilities of the first and second portions H1 and H2 of the conveyance screw 53 in the above-described first embodiment. It is to be noted that, elements of the second embodiment similar to those of the first embodiment can act similarly and attain effects similar to the descriptions above, thus omitting descriptions thereof.

Additionally, in the configuration shown in FIG. 17, to facilitate discharge of toner through the return opening 67, a blade of the opposite direction may be provided to an end of the second conveyance screw 53B, thereby forming a component corresponding to the third portion H3 shown in FIGS. 5 and 6. In such a configuration, it is desirable that the ends of the blades (winding in the opposite directions) of the first and second conveyance screws 53A and 53B are different in rotational phase similarly to the configuration shown in FIG. 7.

It is to be noted that, when the amount of toner inside the developer chamber 51 is small, the amount of toner conveyed to the return opening 67 tends to be smaller than that in a state in which the amount of toner is greater. When the amount of toner conveyed to the return opening 67 decreases, it is possible that the amount of toner discharged through the discharge outlet 52 decreases because toner pressure downstream from the discharge outlet 52 in the toner conveyance direction decreases.

In view of the foregoing, in the second embodiment, to adjust the toner pressure in the area downstream from the discharge outlet 52, the rotational velocity of the second conveyance screw 53B can be varied corresponding to the amount of toner inside the developer chamber 51, thereby changing the toner conveyance velocity. Specifically, the rotational velocity of the second conveyance screw 53B can be adjusted such that a toner conveyance velocity Q2*a* for a state in which the amount of toner inside the developer chamber 51 is greater is faster than a toner conveyance velocity Q2*b* for a state in which the amount of toner inside the developer chamber 51 is smaller (Q2*a*>Q2*b*). By contrast, the toner conveyance velocity of the first conveyance screw 53A is kept constant regardless of the amount of toner inside the developer chamber 51. Thus, relative velocities of the toner conveyance velocity Q1 of the first conveyance screw 53A and the toner conveyance velocities Q2*a* and Q2*b* can be expressed as Q1>Q2*a*>Q2*b*.

By controlling the toner conveyance velocity (rotational velocity of the toner conveyance screw) as described above, the toner conveyance velocity can be reduced when the amount of toner inside the developer chamber 51 is small. It helps the toner to accumulate downstream from the discharge outlet 52 in the toner conveyance direction. As a result, decreases in toner pressure in the area downstream from the discharge outlet 52 can be restricted, thereby stabilizing the amount of toner discharged through the discharge outlet 52.

Descriptions are given below of toner cartridges according to other embodiments with reference to FIGS. 18 through 26. It is to be noted that, other than differences described below, configuration and operation of elements of the following embodiments are similar to those of the first embodiment, attaining similar effects. Thus, descriptions thereof are omitted.

Figure 18:
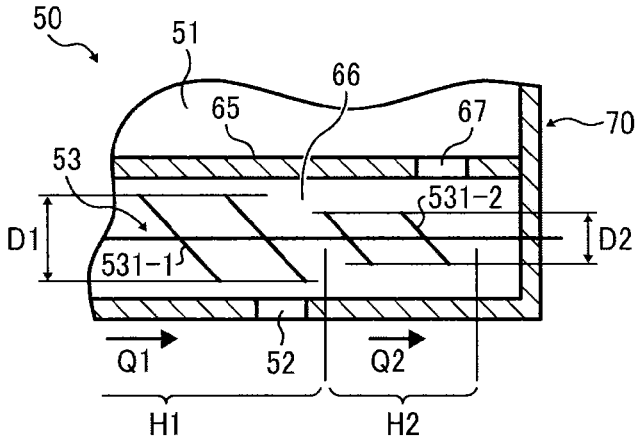
FIG. 18 is a cross-sectional view of a toner cartridge according to another embodiment.

FIG. 18 is a cross-sectional view of a toner cartridge according to another embodiment.

Also in the configuration shown in FIG. 18, the conveyance screw 53 includes the first portion H1 to transport the toner inside the developer chamber 51 to the discharge outlet 52 and the second portion H2 to transport the toner that is not discharged through the discharge outlet 52 to the return opening 67.

The configuration shown in FIG. 18, however, is different from the first embodiment in that the outer diameter (D1 and D2 shown in FIG. 18) of the spiral blade 531 is different between the first and second portions H1 and H2 to cause differences in the toner conveyance velocities thereof. Hereinafter the spiral blades of the first and second portions H1 and H2 are referred to as spiral blades 531-1 and 531-2, respectively. Specifically, the outer diameter D2 of the spiral blade 531-2 of the second portion H2 is made smaller than the outer diameter D1 of the spiral blade 531-1 of the first portion H1 so that the toner conveyance velocity Q2 of the second portion H2 is slower than the toner conveyance velocity Q1 of the first portion H1 (Q1>Q2).

The configuration shown in FIG. 18, in which the toner conveyance velocity Q2 of the second portion H2 is made slower than the toner conveyance velocity Q1 of the first portion H1 by the difference in outer diameter between the spiral blades 531-1 and 531-2, can increase the toner pressure downstream from the discharge outlet 52 and facilitate discharge of toner through the discharge outlet 52 similarly to the above-described embodiments.

Figure 19:
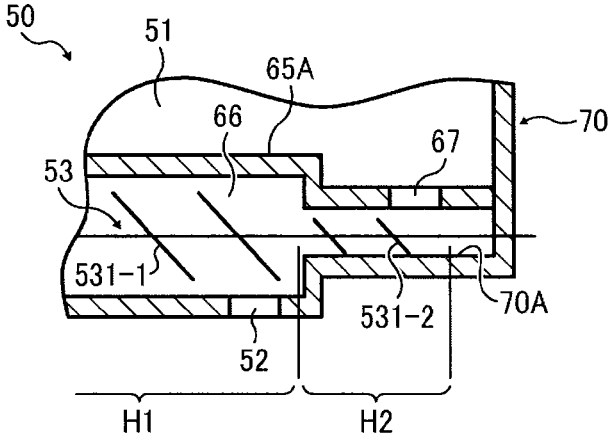
FIG. 19 is a cross-sectional view of a toner cartridge according to a variation of the configuration shown in FIG. 18.

FIG. 19 is a cross-sectional view of a toner cartridge as a variation of the configuration shown in FIG. 18.

In the configuration shown in FIG. 19, a canopy 65A and the container body 70, together defining the developer conveyance chamber 66, are different in shape from those in the above-described embodiments. Other than that, the configuration shown in FIG. 19 is similar to that shown in FIG. 18. The canopy 65A and the container body 70 are shaped such that the developer conveyance chamber 66 between the canopy 65A and the inner bottom face 70A of the container body 70 is narrower on the side on which the return opening 67 is provided. This configuration can reduced the clearance between the small-diameter spiral blade 531-2 and the canopy 65A and that between the spiral blade 531-2 and the inner bottom face 70A in the second portion H2. This configuration can reduce the possibility of toner clogging the downstream side of the developer conveyance chamber 66 or the return opening 67.

Figure 20:
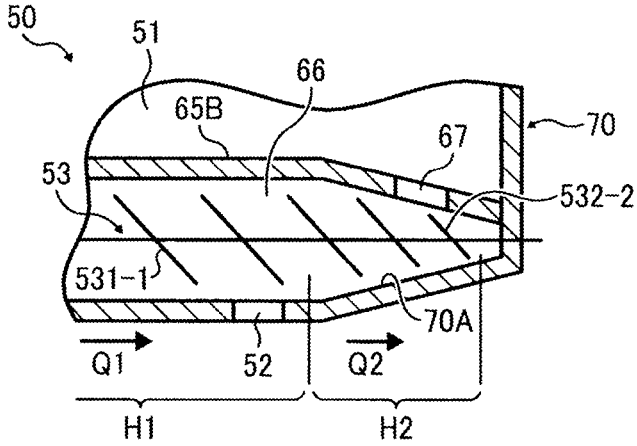
FIG. 20 is a cross-sectional view of a toner cartridge according to another variation of the configuration shown in FIG. 18.

Alternatively, as another variation, the spiral blade 531-2 of the second portion H2 may be reduced in diameter gradually downstream in the toner conveyance direction as shown in FIG. 20. In this configuration, additionally, a canopy 65B and the inner bottom face 70A of the container body 70 may be tapered or inclined to reduce the size of the developer conveyance chamber 66 on the downstream side.

With the reduction in diameter of the spiral blade 531-2 of the second portion H2, the toner conveyance velocity Q2 of the second portion H2 can be slower than the toner conveyance velocity Q1 of the first portion H1. Accordingly, this configuration can increase the toner pressure downstream from the discharge outlet 52 and facilitate discharge of toner through the discharge outlet 52 similarly to the above-described embodiments.

Additionally, with the tapered or inclined canopy 65B and container body 70, the clearance between the spiral blade 531-2 and the canopy 65B or the container body 70 can be reduced. Thus, accumulation and agglomeration of toner in such clearances can be inhibited, thereby inhibiting toner from clogging the developer conveyance chamber 66 or the return opening 67. Further, toner can be prevented from staying on the canopy 65B or the inner bottom face 70A, thereby inhibiting retention of toner.

Figure 21:
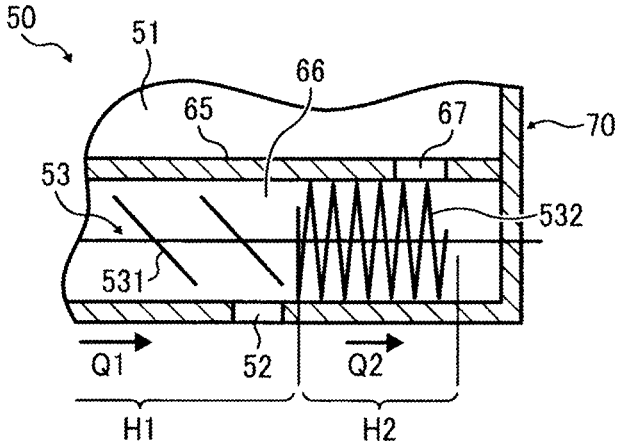
FIG. 21 is a cross-sectional view of a toner cartridge according to another embodiment.

FIG. 21 is a cross-sectional view of a toner cartridge according to another embodiment.

In the configuration shown in FIG. 21, a coil 532 constructed of, for example, a spiral wire rod is provided to the second portion H2 of the conveyance screw 53. Providing the coil 532 to the second portion H2, instead of the spiral blade 531, can make the toner conveyance velocity Q2 of the second portion H2 slower than that of the first portion H1 in which the spiral blade 531 is provided. Accordingly, this configuration can increase the toner pressure downstream from the discharge outlet 52 with the difference in the toner conveyance velocity between the first portions H1 and H2 and accordingly facilitate discharge of toner through the discharge outlet 52 similarly to the above-described embodiments.

Examples of the material of the coil 532 include SW-C-type hard drawn steel wires. In the configuration shown in FIG. 21, an upstream end of the coil 532 in the toner conveyance direction is inserted into a hole formed in the conveyance screw 53, and thus the coil 532 is cantilevered. Additionally, when the coil 532 is used as a conveyance means of the second portion H2, clearance between the coil 532 and the canopy 65 or the inner bottom face 70A of the container body 70 can be reduced easily.

It is to be noted that, similarly to the first embodiment, the third portion H3 may be provided downstream from the second portion H2 in the configurations shown in FIGS. 18 through 21. In such a configuration, it is desirable that the ends of the blades (winding in the opposite directions) in the second portion H2 and the third portion H3 are different in rotational phase similarly to the configuration shown in FIG. 7.

Figure 22:
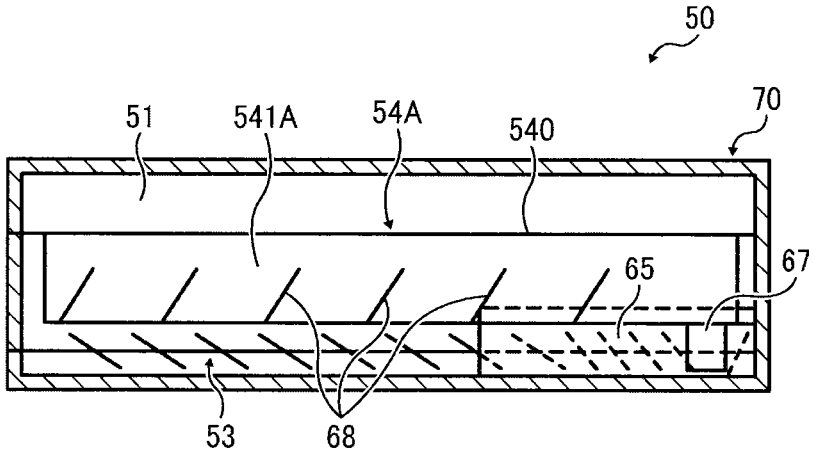
FIG. 22 is a plan view illustrating a cross section of a toner cartridge according to another embodiment.

FIG. 22 is a plan view illustrating a cross section of a toner cartridge according to another embodiment.

In the configuration shown in FIG. 22, an agitator 54A is different from the agitator 54 according to the above-described embodiments in that multiple slits 68 inclined to the axial direction are formed on an edge side of (opposite the shaft 540) a blade 541A of the agitator 54A. Specifically, the slits 68 are inclined such that an end of each slit 68 on the edge side of the blade 541A is on the upstream side (on the left in FIG. 22) and the other end thereof (closer to the shaft 540) is on the downstream side (on the right in FIG. 22) in the toner conveyance direction. That is, each slit 68 is inclined in the direction opposite the toner conveyance direction as the position approaches the edge of the blade 541A (away from the shaft 540).

With the slits 68 inclined as described above, the edge side of the blade 541A can deform more easily than its base side, and the rotation of the edge side of the blade 541A is delayed from the shaft side of the blade 541A as the agitator 54A rotates. Consequently, a greater amount of toner can present at the edge side of the blade 541A than the shaft side thereof, and the toner can be transported upstream in the toner conveyance direction of the conveyance screw 53.

Thus, in this configuration, the rotary agitator 54A can forward the toner discharged through the return opening 67 upstream in the toner conveyance direction of the conveyance screw 53. Accordingly, the toner pressure at the return opening 67 can be reduced, thus facilitating discharge of toner through the return opening 67.

Figure 23:
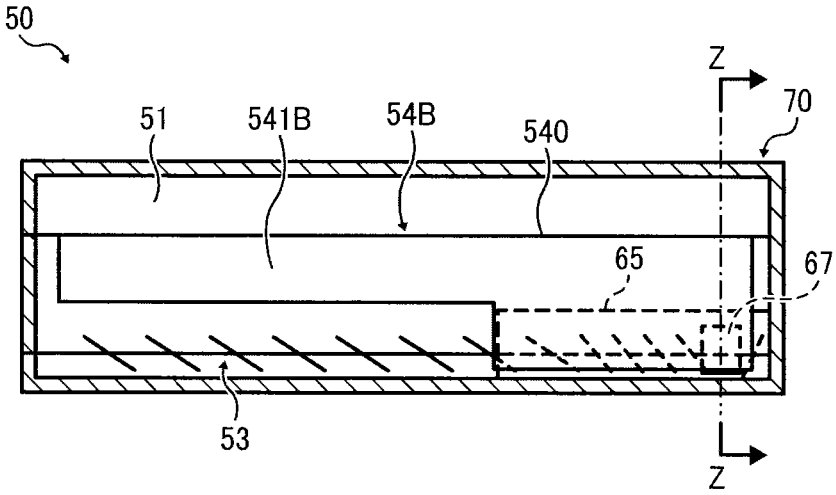
FIG. 23 is a plan view illustrating a cross section of a toner cartridge according to another embodiment.
Figure 24:
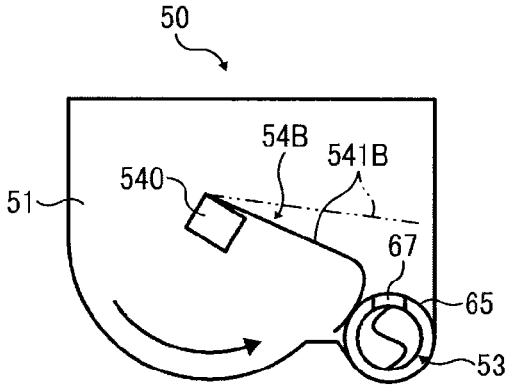
FIG. 24 illustrates a cross section (along line Y in FIG. 23) of an end portion of the toner cartridge where the canopy is provided.

FIG. 23 is a plan view illustrating a toner cartridge according to another embodiment, and FIG. 24 illustrates a cross section (along line Z-Z in FIG. 23) of an end portion of the toner cartridge where the canopy is provided.

In the configuration shown in FIG. 23, an agitator 54B is different from the agitator 54 according to the above-described embodiments in that a width (perpendicular to the axial direction) of a blade 541B is longer in the area facing the canopy 65 than that in the area where the canopy 65 is not provided (upstream area from the canopy 65 in the toner conveyance direction). The wider portion of the blade 541B is designed to move in an area above the return opening 67 formed in the canopy 65.

With the blade 541B moving above the return opening 67, the toner discharged through the return opening 67 can be moved away. Additionally, in this configuration, since the amount of deformation of the blade 541B of the agitator 54B is greater in the area facing the return opening 67, toner agitation effects can be enhanced particularly adjacent to the return opening 67. Therefore, accumulation of toner adjacent to the return opening 67 can be inhibited, thus facilitating discharge of toner through the return opening 67.

Figure 25:
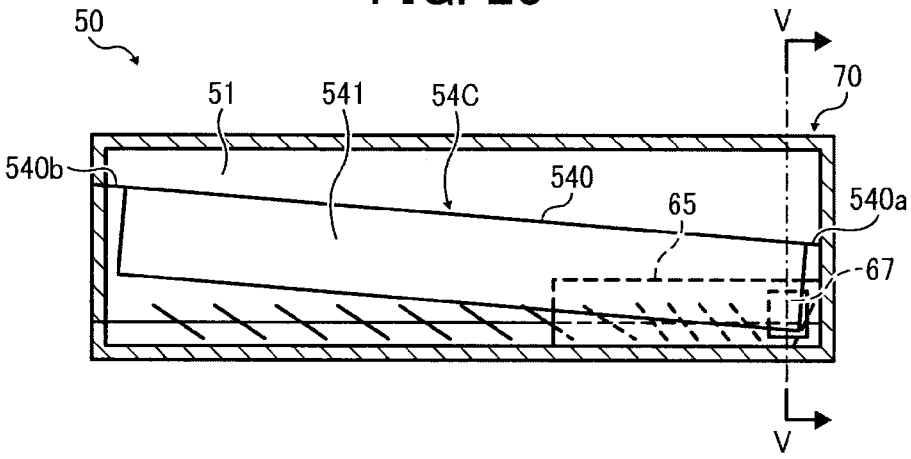
FIG. 25 is a cross-sectional view illustrating a cross section of a toner cartridge according to another embodiment.
Figure 26:
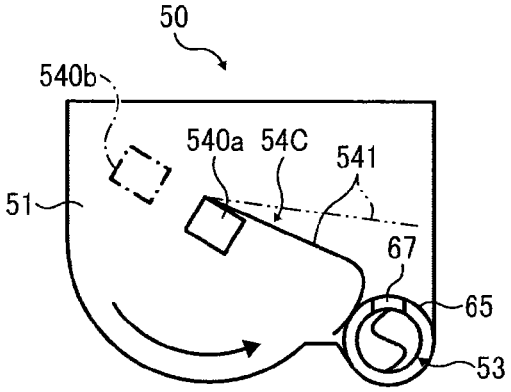
FIG. 26 illustrates a cross section (along line V in FIG. 25) of an end portion of the toner cartridge where the canopy is provided.

FIG. 25 is a plan view illustrating a toner cartridge according to another embodiment, and FIG. 26 illustrates a cross section (along line V-V in FIG. 25) of an end portion of the toner cartridge where the canopy is provided.

An agitator 54C in the configuration shown in FIG. 25 is inclined such that the rotary shaft 540 approaches the return opening 67 or the canopy 65 from an end portion 540*b* away from the return opening 67 to the other end portion 540*a*, which is close to the return opening 67. When the agitator 54C is thus inclined, the blade 541 can move in the area above the return opening 67 although a part of the blade 541 is not widened differently from the configuration shown in FIGS. 23 and 24.

Accordingly, while moving above the return opening 67, the blade 541 of the agitator 54C can move away the toner discharged through the return opening 67. Additionally, in this configuration, since the amount of deformation of the blade 541 of the agitator 54C is greater in the area facing the return opening 67, toner agitation effects can be enhanced particularly adjacent to the return opening 67. Consequently, accumulation of toner adjacent to the return opening 67 can be inhibited, thus facilitating discharge of toner through the return opening 67.

It is to be noted that the slits 68 may be formed in the blade 541 shown in FIG. 25 or the blade 541B shown in FIG. 23 similarly to the configuration shown in FIG. 22.

It is to be noted that the image forming apparatus to which the features of this disclosure are applied is not limited to multicolor laser printers but may be single-color or multiple printers of other types, copiers, facsimile machines, or multifunction machines having these capabilities.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developer container comprising:

a container body in which a developer containing chamber for containing developer and a discharge outlet to discharge the developer from the developer containing chamber are formed;

a developer conveyance member provided inside the container body to transport the developer inside the developer containing chamber, the developer conveyance member including a first conveyance portion to transport the developer toward the discharge outlet and a second conveyance portion downstream from the first conveyance portion in a developer conveyance direction of the developer conveyance member;

a canopy disposed inside the container body and facing the discharge outlet via the developer conveyance member, a developer conveyance chamber defined by the canopy and an inner face of the container body in which the discharge outlet is formed, the developer conveyance chamber in which the developer conveyance member transports the developer; and a return opening formed in the canopy to return the developer from the developer conveyance chamber to the developer containing chamber, the return opening positioned downstream from the discharge outlet in the developer conveyance direction of the developer conveyance member, wherein the second conveyance portion of the developer conveyance member transports the developer toward the return opening formed in the canopy, and a developer conveyance velocity (Q2) of the second conveyance portion of the developer conveyance member is slower than a developer conveyance velocity (Q1) of the first conveyance portion.

2. The developer container according to claim 1, wherein, when Q1 represents the developer conveyance velocity of the first conveyance portion, Q2*a* represents the developer conveyance velocity of the second conveyance portion for a state in which the amount of developer inside the developer containing chamber is greater, and Q2*b* represents the developer conveyance velocity of the second conveyance portion for a state in which the amount of toner inside the developer containing chamber is smaller, $Q1>Q2a>Q2b$.

3. The developer container according to claim 1, wherein the developer conveyance member further comprises a third conveyance portion downstream from the second conveyance portion in the developer conveyance direction of the developer conveyance member, and a developer conveyance direction of the third conveyance portion is opposite to a developer conveyance direction of the first and second conveyance portions of the developer conveyance member.

4. The developer container according to claim 3, wherein each of the second and third conveyance portions of the developer conveyance member comprises a rotary shaft and a spiral blade provided on an outer circumference of the rotary shaft, wherein a downstream blade end of the spiral blade of the second conveyance portion in the toner conveyance direction of the second conveyance portion is different in rotational phase from a downstream blade end of the spiral blade of the third conveyance portion in the developer conveyance direction of the third conveyance portion.

5. The developer container according to claim 4, wherein, when N1 represents an interval between the downstream blade end of the second conveyance portion and the downstream blade end of the third conveyance portion in an axial direction of the developer conveyance member, and N2 represents a length of the return opening in the axial direction of the developer conveyance member, $N1<N2$.

6. The developer container according to claim 1, wherein an opening area of the discharge outlet is equal to or greater than an opening area of the return opening formed in the canopy.

7. A development unit comprising:

a development housing for containing developer;

a developer bearer to carry by rotation the developer from the development housing to a latent image bearer; and the developer container according to claim 1, wherein the developer is supplied from the developer container to the development housing.

8. A process cartridge removably installable in an image forming apparatus, the process cartridge comprising:

the development unit according to claim 7; and the latent image bearer on which a latent image is formed.

9. An image forming apparatus comprising:

the development unit according to claim 7; and the latent image bearer on which a latent image is formed.

* * * * *